United States Patent [19]

Cunningham

[11] 4,356,069

[45] Oct. 26, 1982

[54] STRIPPING COMPOSITION AND METHOD FOR PREPARING AND USING SAME

[76] Inventor: Ross Cunningham, 508 Ridge Ct. East, Old Hickory, Tenn. 37138

[21] Appl. No.: 241,889

[22] Filed: Mar. 9, 1981

[51] Int. Cl.[3] ..... C25F 5/00

[52] U.S. Cl. ..... 204/146; 204/129.9

[58] Field of Search ..... 204/146, 129.9, 129.95; 252/79.2

[56] References Cited

U.S. PATENT DOCUMENTS

| | | | |
|---|---|---|---|
| 2,982,625 | 5/1961 | Saubestre | 252/79.2 |
| 3,373,113 | 3/1968 | Achenbach | 252/79.2 |
| 3,793,172 | 2/1974 | Cadieux | 204/146 |
| 4,128,463 | 12/1978 | Formanik | 204/146 |

FOREIGN PATENT DOCUMENTS

| | | | |
|---|---|---|---|
| 639973 | 12/1978 | U.S.S.R. | 252/79.2 |

OTHER PUBLICATIONS

Metal Cleaning and Finishing, Nov. 1933, pp. 464–466, 475.

*Primary Examiner*—T. Tufariello

*Attorney, Agent, or Firm*—Biebel, French & Nauman

[57] ABSTRACT

An aqueous solution of chromic acid, peroxide, and sulfuric acid is prepared as a stripping composition. The stripping composition is intended for use in the reverse current stripping of plated metal substrates, such as chrome and/or nickel plated metal substrate, to prepare the metal substrate for replating.

3 Claims, No Drawings

STRIPPING COMPOSITION AND METHOD FOR PREPARING AND USING SAME

BACKGROUND OF THE INVENTION

This invention relates to a stripping composition and method for preparing and using the stripping composition in reverse current stripping of plated metal substrates to condition the substrate for replating, and, more particularly, it relates to a sulfuric acid, chromic acid, and peroxide containing aqueous solution which can be used as the stripping composition.

Electrodeposition of metal is a widely used technique for applying a thin decorative and/or protective layer of a more noble metal on a baser metal substrate. Chrome plating is exemplarary. In electro-plating of chromium, the base metal substrate, such as zinc, aluminum, steel, brass, copper, etc., is placed in a bath of chromium plating solution. A direct current is applied between the base metal substrate which is to be plated and a metal anode which is also located in the bath, making the base metal substrate the cathode. The chromium plating solution typically contains chromic acid, sulfuric acid and water, with a critically high percentage of the solution being chromic acid. While a number of compounds are formed in the bath, the basic reaction involves reduction of hexavalent chromium at the cathode to form a trivalent chromium, with the accompanying deposition of chromium on the base metal substrate. At the anode the trivalent chromium is reoxidized to the hexavalent form.

While the procedure produces a bright, hard and lustrous chrome plated substrate, the chromium tends to wear excessively. For this reason chrome plating is often combined with nickel plating since nickel has extremely good wearing properties. Even then, chrome plated substrates may sooner or later need to be replaced. Often the replaced item is discarded.

It is now believed that discarded chrome plated items lead to chromium ion polution of the ground waters located near the disposal site. Accordingly, stripping and replating of the chrome plated items, with safe disposal of the material removed during stripping operation, is becoming more and more necessary and desirable. Unfortunately, an efficient method for stripping chrome and nickel plated metal substrates does not exist.

Of course, stripping or pickling compositions are known. Likewise, electrolytic pickling has long been used to clean substrates prior to electrodeposition of more noble metals on the substrate surface. In electrolytic pickling the article to be plated is suspended in a weak acid bath (hydrochloric or sulfuric acid), and in this phase of the operation connected to the positive pole of a source of current with a sheet of metal connected with the negative pole. The $SO_4$ and/or chloride ions produce a pickling effect when separated on the anode.

Finally, it has been suggested that such reverse current (as compared to the current flow in electrodeposition) situations can be used in stripping the plating material from the plated substrate in a manner similar to electrolytic pickling. However, the baths used in the previous systems are not completely effective and result in only partial stripping and/or degradation of the base metal substrate from which the metal plating is being stripped.

Accordingly, the need exists for an efficient, effective method for stripping chrome and nickel plated metal substrates and for an improved stripping composition which can be used as the bath in a reverse current stripping process.

SUMMARY OF THE INVENTION

The present invention meets that need by providing a stripping composition which, when used in a reverse current stripping process, is effective in removing chromium and nickel from the base metal substrates. Following stripping, the base metal substrate is in condition for being replated by an electrodeposition process. It has been found that the substrate is not pitted, weakened, or otherwise degraded, as is often the case with prior art reverse current stripping processes.

The stripping composition of the present invention is an aqueous solution of chromic acid, peroxide and sulfuric acid. The peroxide is preferably hydrogen peroxide; although, other peroxides, such as barium peroxide, may be used. The solution is prepared by adding 2–10 ounces, and preferably 2–4 ounces $CrO_3$ (dry weight) to each gallon of sulfuric acid. The chromic acid is preferably mixed into a 20–25% concentration aqueous solution prior to adding to the sulfuric acid. The sulfuric acid is preferably a 55° to 35° Baume sulfuric acid. The mixture is allowed to cool, and an appropriate amount (approximately 100–300 ml/gal) of a 35% hydrogen peroxide solution is added.

In a reverse stripping process, the stripping composition of the present invention aids in the removal of chromium and nickel ions from the surface of the base metal, such as zinc, steel, aluminum, brass or copper which had previously been plated with the chrome and/or nickel. In addition, it is believed that the present composition forms as an intermediate in the process an oxide (formed by the action of the chromic acid and peroxide) layer on the base metal substrate which prevents attack of the base metal substrate by the sulfuric acid during the process. The oxide layer is removed by simple cathodic cleaning or by buffing or polishing.

It is, therefore, an object of the present invention to provide an improved stripping composition comprising an aqueous solution containing chromic acid, peroxide, and sulfuric acid and a method for preparing and using that stripping composition.

Other objects and advantages of the invention will be apparent from the following description and the appended claims.

DESCRIPTION OF THE PREFERRED EMBODIMENT

For the purpose of illustrating the preferred embodiment, there will be discussed a stripping composition which is especially adapted for use in the reverse current stripping of chrome and/or nickel plated metal substrates in order to provide a cleaned substrate ready for replating. However, it should be realized that replating of the substrate is only one use which can be made of the stripped substrate. Obviously, the stripping composition can be used to clean metal substrates for other purposes; and can be used in other processes in addition to reverse current stripping. Likewise, di- and tri-valent ions other than chromium and nickel can be removed from a plated metal substrate since the electrochemical principles involved will apply in many other instances as well.

Those electrochemical principles, as mentioned, are the oxidation at the anode of metal ions in the electrolyte. Thus, a chromium plated metal substrate to be stripped with the stripping composition of the instant invention is used as the anode. A current of 20–80 amps/sq.ft. is applied as a direct current between the anode and a metal cathode.

The electrolyte in the bath is the stripping composition of the present invention. It is an aqueous solution having the following ingredients: chromic acid ($CrO_3$), a peroxide, preferably hydrogen peroxide ($H_2O_2$), sulfuric acid ($H_2SO_4$) and water ($H_2O$). The method of preparing the stripping composition is also important since exothermic reactions are involved and the order of addition of the ingredients is significant.

Thus, it is preferred that the chromic acid be in solution form having a 20–25% $CrO_3$ concentration by weight. In solution form it is represented by the formula $H_2CrO_4$. Preferably 225–1500 ml/gal (6–38 parts by volume) amount of this chromic acid solution, is added to each gallon of sulfuric acid. In terms of dry weight of $CrO_3$ added to each gallon of $H_2SO_4$, this ranges from 2–10 ounces, and is preferably 2–4 ounces. The sulfuric acid itself is an aqueous solution of $H_2SO_4$ and water. Preferred is a 50° Baume solution, i.e. one having a 62.2% $H_2SO_4$ concentration by weight and a specific gravity of 1.53. Other sulfuric acids in the 55°–35° Baume range may be used as well. The chromic acid solution is added to the sulfuric acid preferably at between room temperature and 120° F.

Because an elevated temperature may be used and since the reaction between $CrO_3$ and $H_2SO_4$ is slightly exothermic, the solution should thereafter be cooled. At room temperature cooling takes about 10–15 hours. As will be apparent, the solution can be chiled to accomplish the cooling more rapidly.

Once cooled, the peroxide is added. Preferred is a hydrogen peroxide which has a 35% $H_2O_2$ concentration by weight in water. Technical grades of hydrogen peroxide at this concentration are available. Other concentrations may also be used, as may other peroxides. The preferred amount used is 100–300 ml of this peroxide solution per gallon of chromic acid—sulfuric acid solution (2–8 parts by volume). More may be added without deleterious effect, but is not necessary to achieve the result desired.

The stripping solution is now complete in terms of active ingredients. Clearly, it may contain amounts of any number of inactive ingredients as well. The exact chemistry of the products within the stripping solution after mixing is not known.

It is believed, however, that a trivalent form of chromium such as chromium sulfate or chromium dichromate is formed and that the trivalent chromium is oxidized at the anode to form a hexavalent chromium. In the process the chromium metal plated on the base metal substrate of the anode will be stripped therefrom. The peroxide is believed in the process to form an intermediate oxide layer on the surface of the base metal substrate which will protect the metal from attack by the sulfuric acid.

After the oxide is removed by cathodic cleaning, the base metal substrate may be replated with chromium (or other plating metals) using known electrodeposition techniques. It has been found that replating is particularly easy when the previously plated metal substrate has been stripped by the process of the present invention using the instant stripping composition since the stripped surface is completely cleaned of the metal previously plated thereon, but has not been degraded or damaged during the stripping process.

While the method and composition herein described constitutes a preferred embodiment of the invention, it is to be understood that the invention is not limited to this precise method and composition, and that changes may be made therein without departing from the scope of the invention which is defined in the appended claims.

What is claimed is:

1. A method for stripping chromium or nickel from the surface of a chromium or nickel plated metal substrate selected from the group consisting of zinc, steel, aluminium, brass and copper, comprising:

(a) immersing said plated metal substrate in a bath containing an aqueous solution of chromic acid, peroxide, and sulfuric acid in sufficient concentrations to remove said chromium or nickel from said plated metal substrate in a reverse current stripping process, (b) immersing a metal cathode in said bath, (c) applying a positive potential to said plated metal substrate and a negative potential to said metal cathode with a direct current therebetween at a sufficient current density and for a sufficient period of time to strip said chromium or nickel from said plated metal substrate, and (d) removing the stripped metal substrate from said bath.

2. A method for preparing stripping composition, comprising:

(a) adding 225–1500 ml of a 20–25% concentration chromic acid solution per gallon of 55°–35° Baume sulfuric acid, (b) cooling the chromic acid-sulfuric acid solution, and (c) adding 100–300 ml of a 35% concentration hydrogen peroxide per gallon of chromic acid-sulfuric acid solution to said chromic acid-sulfuric acid solution.

3. A stripping composition for use in reverse current stripping of plated metal substrates, comprising:

(a) 6–38 parts by volume of a 20–25% aqueous chromic acid solution, (b) 2–8 parts by volume of a 35% aqueous hydrogen peroxide solution, and (c) the remainder a 55°–35° Baune sulfuric acid.

* * * * *